United States Patent [19]

Okumura et al.

[11] Patent Number: 4,540,861

[45] Date of Patent: Sep. 10, 1985

[54] CONTACT MATERIAL FOR VACUUM CIRCUIT INTERRUPTER

[75] Inventors: Mitsuhiro Okumura; Eizo Naya; Mitsumasa Yorita; Yasushi Takeya, all of Hyogo, Japan

[73] Assignee: Mitsubishi Denki Kabushiki Kaisha, Tokyo, Japan

[21] Appl. No.: 599,359

[22] Filed: Apr. 12, 1984

[30] Foreign Application Priority Data

May 18, 1983 [JP] Japan ..... 58-88428

[51] Int. Cl.[3] ..... H01H 33/66

[52] U.S. Cl. ..... 200/144 B; 200/262; 200/265; 200/266

[58] Field of Search ..... 200/144 B, 262, 265, 200/266

[56] References Cited

U.S. PATENT DOCUMENTS 3,592,987 7/1971 Lempert et al. ..... 200/144 B
3,612,795 11/1971 Emmerich ..... 200/144 B
4,323,590 4/1982 Lipperts ..... 200/262

FOREIGN PATENT DOCUMENTS 1194674 6/1970 United Kingdom ..... 200/144 B
2105910 3/1983 United Kingdom ..... 200/144 B

*Primary Examiner*—Robert S. Macon
*Attorney, Agent, or Firm*—Sughrue, Mion, Zinn, Macpeak, and Seas

[57] ABSTRACT

A contact material for use in a vacuum circuit interrupter which simultaneously provides superior current interrupting performance and breakdown voltage. The contact material of the invention includes components of copper, tantalum and at least one of cobalt and iron. Cobalt or iron should be present in an amount of 50 wt % or less, while the combination of tantalum and cobalt or iron should be present in an amount of at least 10 wt %. A fourth component of at least one of titanium, zirconium and aluminum may be added. Also, there may be included a fifth component containing at least one of a low melting point metal, alloys of a low melting point metal, intermetallic compounds of a low melting point metal, and oxides thereof, with the low melting point metal being at least one of bismuth, tellurium, antimony, thallium, lead, selenium, cerium and calcium in an amount of not more than 20 wt %.

6 Claims, 6 Drawing Figures

CONTACT MATERIAL FOR VACUUM CIRCUIT INTERRUPTER

BACKGROUND OF THE INVENTION

This invention relates to a contact material for use in a vacuum circuit interrupter, and which is superior in current interrupting performance and breakdown voltage.

Vacuum circuit interrupters have been widely used because they are largely maintenance free, pollution free, provide superior interrupting performance, etc. With such interrupters, a large interrupting capacity and a high breakdown voltage are required. The ability to meet these requirements depends largely on the type of contact material employed.

Desirable properties of the contact material used for vacuum circuit interrupters include a large interrupting capacity, high breakdown voltage, small contact resistance, low melt bonding, small contact erosion, small chopping current, good reproducibility, high mechanical strength, etc.

It is very difficult to provide a material which simultaneously satisfies all of these properties, and practical materials satisfy only specific properties necessary for a specific application, sacrificing other properties to some extent.

U.S. Pat. No. 3,379,846 discloses a contact material which is prepared by melt-diffusing a reactive metal such as Zr or Ti and a high purity metal such as Co, Ag or Au into a sintered refractory metal such as W, Mo, Re, Nb or Ta. U.S. Pat. No. 3,859,089 discloses similar materials.

Coppper-bismuth (Cu-Bi), copper-cobalt (Cu-Co), copper-chromium (Cu-Cr), copper-cobalt-bismuth (Cu-Co-Bi), copper-chromium-bismuth (Cu-Cr-Bi) and copper-beryllium (Co-Be), etc. have been used widely as contact materials in view of total performance. CuBi is a non-solid solution of copper which exhibits a high electric conductivity. The amount of bismuth, which is a low-melting point metal and which forms substantially no solid solution with copper, is equal to or larger than a solid solution limit thereof. Although this combination exhibits a good interrupting performance and an anti-melting adhesion capability, the breakdown voltage thereof is considerably low. Specifically, because copper has a high melting point and bismuth is subjected to evaporation and scattering at times of connecting or interrupting a large current and in high voltage applications when contacts are in the open state, the breakdown voltage is low, leading to a degradation of current interrupting performance over time.

U.S. Pat. No. 4,302,514 discloses a contact material composed of copper in which at least one of Cr, Fe and Co is uniformly dispersed with the particle size of the latter being in a range of 80 to 300 μm or in a range of 30 μm or smaller. However, when this material is used to form contacts, the material tends to evaporate at high temperatures in the vacuum container and hence to be deposited on the walls of metal shields and insulating members, resulting in a reduction of the breakdown voltage of the interrupter. Therefore, materials of this kind make the interrupting current large, and thus such materials are not suitable to form contacts of an interrupter for which a high breakdown voltage performance is required. Further, if the amount of copper thereof is larger than a certain value and if the particle size of the dispersed metal is appropriately selected, the interrupting performance is also superior, and therefore such materials have frequently been used for high-voltage, large-current interrupters. However, the anti-melt bonding performance thereof is relatively poor.

Cu-Co-Bi, Cu-Cr-Bi, etc. have intermediate properties between the above mentioned binary combinations. That is, both of these ternary combinations exhibit relatively superior breakdown performance and interrupting performance and further exhibit superior anti-melt bonding properties due to the presence of Bi. Therefore, such ternary combinations have been used widely. However, since they contain a low melting point metal, the maximum current and voltage which can be applied thereto are necessarily limited.

Therefore, none of the above-discussed materials is fully satisfactory to meet recent demands for higher performance. Because the performance requirements for interrupters could hitherto not be met by selection of contact material, it has been usual to select the configuration of the contact and/or specially design current passages in the contact portion so that a specific magnetic field is generated therearound by which a large current arc is forcibly driven to thus improve the interrupting performance to some extent. The latter approach, however, is still insufficient to meet increasing requirements of higher voltage and large current handling capability, and thus superior contact materials are still a pressing need.

SUMMARY OF THE INVENTION

The present invention was made in view of the above mentioned defects of the conventional contact materials.

Accordingly, an object of the invention is to provide a contact material for use in a vacuum circuit interrupter which has a superior large current interrupting performance and high breakdown voltage performance.

In order to find contact materials which exhibit higher interrupting current and higher breakdown voltage performances than those of the conventional materials, the inventors have prepared contact materials each containing copper and an additive of various metal alloys and/or intermetallic compounds and incorporated them into vaccum switch tubes. Various experiments have been conducted by the inventors on the vacuum switch tubes to evaluate these materials.

As a result, it has been discovered that for materials containing copper and an additive of Co or Fe, which have been known as providing high vacuum breakdown voltage performance, the breakdown voltage performance is further improved by increasing the amount of Co or Fe. However, the electrical conductivity of the material is remarkably lowered with an increase of Co or Fe, and thus the interrupting performance is lowered. Therefore, for a material containing Cu and Co or Fe, the amount of Co or Fe should be 20 to 30 wt % or less when the interrupting performance is important, resulting in a degraded breakdown voltage.

As mentioned, a primary object of the invention is to provide a material with which the interrupting performance as well as the breakdown voltage performance is improved. It has been found that the above object can be achieved by a contact material containing a first component of Cu, a second component of Ta, and a third component of at least one of Co and Fe in an amount of 50 wt% or less with the total amount of the second and third components being 10 wt% or more.

DESCRIPTION OF THE PREFERRED EMBODIMENTS

Figure 1:
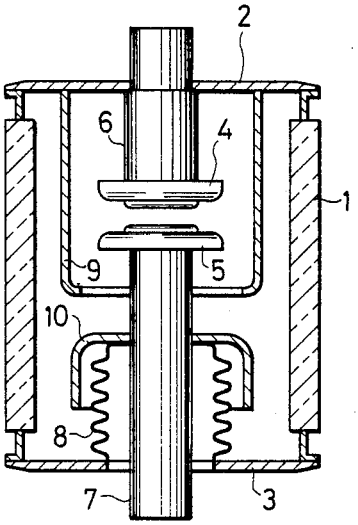
FIG. 1 is a cross-sectional view showing a structure of a typical vacuum switch tube.

FIG. 1 shows the structure of a vacuum switch tube, which includes a vacuum insulating container 1, end plates 2 and 3 closing opposite ends of the container 1, and a pair of electrodes 4 and 5 disposed in the container 1 facing each other and mounted on ends of respective electrode rods 6 and 7. The electrode rod 7 is connected through a bellows 8 to the end plate 3 such that it is movable axially with respect to the electrode rod 6 while an air-tight seal of the container 1 is maintained. In order to prevent an inner wall surface of the container 1 and an outer surface of the bellows 8 from being polluted with metal vapor produced by arcing, etc., they are covered by shields 9 and 10, respectively.

Figure 2:
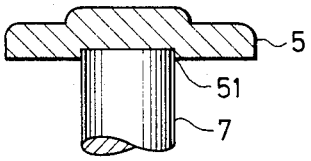
FIG. 2 shows an enlarged cross-sectional view of an electrode portion of the tube in FIG. 1.

FIG. 2 shows the structure of the electrode 4 or 5 in detail. A rear surface of the electrode 5 is welded to the electrode rod 7 by means of welding material 51. The electrodes 4 and 5 are formed of the contact material according to the present invention.

Figure 3:
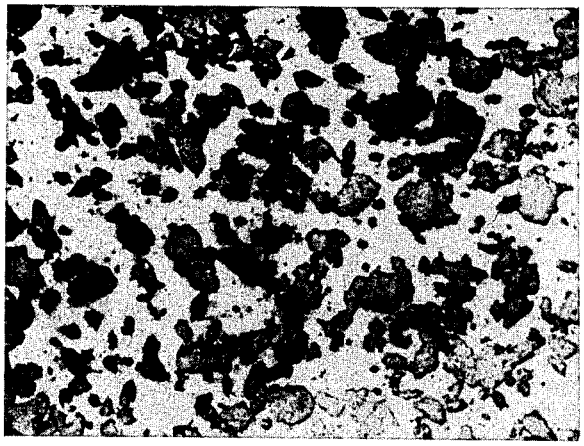
FIG. 3 PRIOR ART
FIG. 3 is a 100× magnified photograph showing the crystal grain structure of a conventional Cu-Co (20 wt% Co) contact alloy prepared by sintering.

FIG. 3 is a 100× magnified photograph showing the crystal grain structure of the conventional Cu-Co alloy contact material for comparison purposes. This contact material is obtained by mixing 80 wt% Cu powder and 20 wt% Co powder, and shaping and sintering the mixture.

Figure 4:
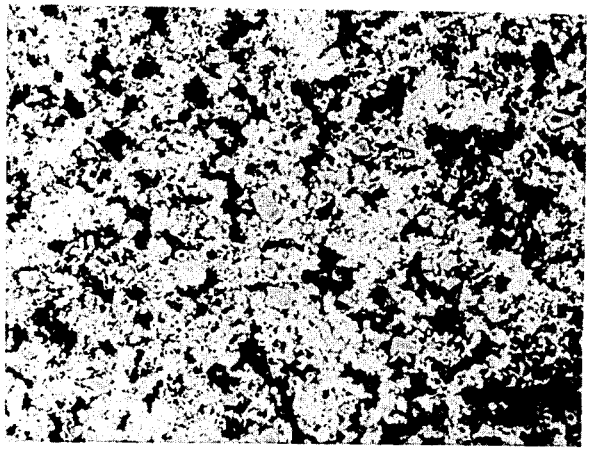
FIG. 4 is a 100× magnified photograph showing the crystal grain structure of a preferred embodiment of a contact material of the invention which contains 73 wt% Cu, 20 wt% Co, and 7 wt% Ta, and is prepared by sintering at a relatively high temperature.

FIG. 4 is a 100× magnified photograph showing the crystal grain structure of a preferred embodiment of a contact material of the present invention, which is a Cu-Co-Ta alloy contact material. The Cu-Co-Ta contact material is prepared by mixing 73 wt% Cu powder, 20 wt% Co powder and 7 wt% Ta powder, and then shaping and sintering the mixture. The sintering is performed under conditions for which portions of the Co and Ta react with each other to form $Co_2Ta$. It will be clear from FIG. 4 that in the alloy of the invention Co, Ta, $Co_2Ta$, etc. are uniformly and finely dispersed in the Cu.

Figure 5:
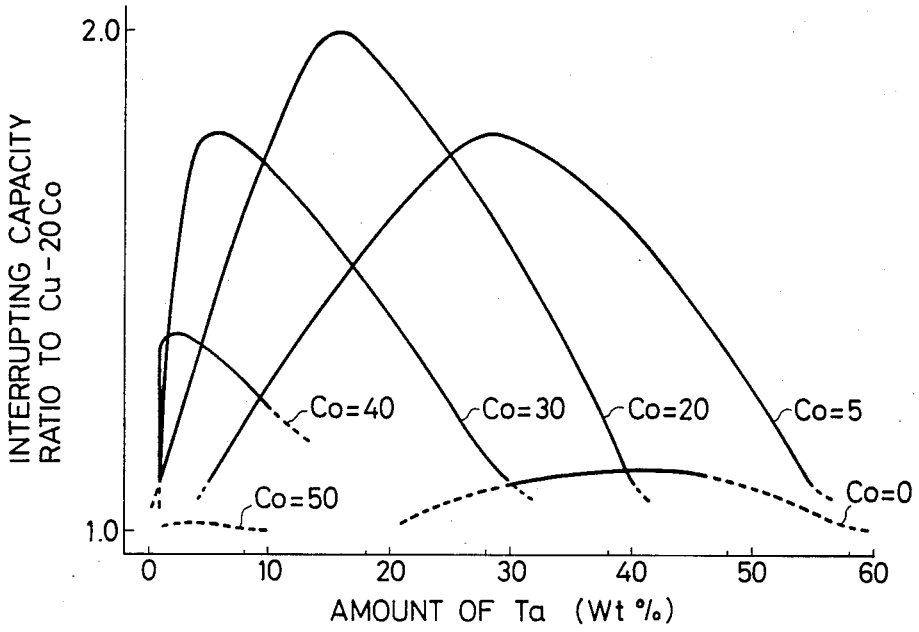
FIG. 5 is a characteristic curve showing the interrupting capacity of the contact material of FIG. 4 with the amount of Co being varied between 0, 5, 20, 30, 40 and 50 wt% as a parameter.

The properties of this contact material will be described with reference to various experiments. In a comparison example, a Cu-Co alloy containing Cu-Co was employed. FIG. 5 is a graph showing the relationship of the interrupting capacity of the inventive Cu-Co-Ta contact material to the amount of Ta with the amount of Co as a parameter in which the interrupting capacity, plotted on the ordinate, is shown at a ratio to the interrupting capacity of the conventional Cu-Co (20 wt% Co) contact material. The amount of Ta is plotted on the abscissa. Further, in FIG. 5, solid lines show values having substantially no variation and dotted lines show values having variations.

From FIG. 5, it is clear that even when the amount of Co is set at 0, i.e., for the case of a Cu-Ta binary alloy, the inventive contact material in a certain range of composition ratio exhibits an interrupting capacity above that of the conventional Cu-Co alloy. However, the difference therebetween is not so large. In any case, it is desirable to set the amount of Ta at 60 wt% or less. When Co is added, i.e., Co and Ta are combined with Cu, a remarkable increase of the interrupting capacity is observed. Particularly, with 20 wt% Co and 15 wt% Ta, the interrupting capacity is remarkably high, about twice that of the conventional Cu-Co (20 wt% Co) alloy. With different amounts of Co, i.e., 5, 10, 20, 30, 40 and 50 wt%, there are peak values of interrupting capacity, indicating that there are optimum values of the ratio of Co and Ta.

When the amount of Co is set at 50 wt% and that of Ta is set at 10 wt% or less, it is possible to obtain a ternary alloy whose interrupting capacity is higher than that of the conventional Cu-Co binary alloy. However, the difference therebetween is not so high, and hence it is desirable to set the amount of Co at 50 wt% or less.

The reason why the conventional Cu-Co binary alloy exhibits a good interrupting capacity when Co is present in an amount of 20 wt% and the interrupting capacity decreases when the amount of Co is increased is that Cu, which has a high electrical conductivity, is used to provide the interrupting performance and Co is used to provide properties other than the interrupting performance such as breakdown voltage.

When Co and Ta are both present, these two elements react with each other in a complicated manner to remarkably improve the interrupting property of the ternary alloy, even though the conductivity of the ternary alloy is lower than that of the conventional binary alloy. This may be for the reason that the superior interrupting performance of the Cu-Co-Ta ternary alloy is not obtained by the electrical and thermal conductivities of Cu.

It should be noted that when the total amount of Co and Ta of the present ternary alloy is increased beyond a certain value, the interrupting performance will be lowered. This may be for reasons that, setting aside the effect obtainable by the presence of both Co and Ta, effects of a relatively reduced amount of Cu may appear. That is, the electrical and thermal conductivities of the contact alloy may be lowered due to the reduced amount of Cu, which leads to a difficulty of quick dissipation of thermal energy due to arcs, resulting in a lowered interrupting performance. Further, since the alloy of the preferred embodiment of the present invention is prepared by a conventional sintering process, the sintering operation becomes difficult when the total amount of Co and Ta exceeds 60 wt%, which may affect the interrupting performance of the contact alloy adversely. Therefore, it is desirable to set the total amount of Co and Ta at 60 wt% or less. On the contrary, the effect of the coexistence of Co and Ta on the interrupting performance is very small when the total amount thereof is 10 wt% or less.

Figure 6:
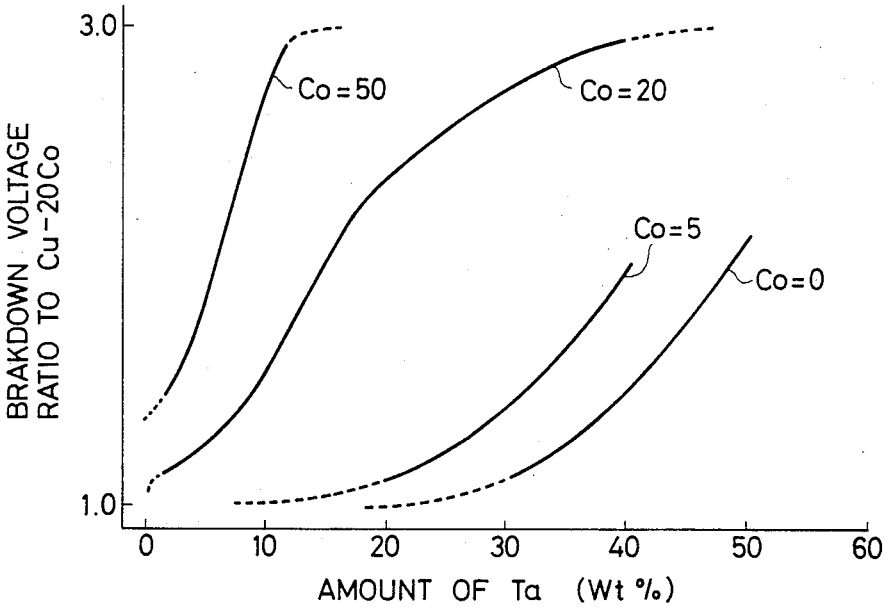
FIG. 6 is a characteristic curve showing the breakdown voltage of the contact material of FIG. 4 with the amount of Co being varied between 0, 5, 20, 30, 40 and 50 wt% as a parameter.

FIG. 6 shows the relation between the breakdown voltage and the amount of Ta of the ternary alloy with the amount of Co being set at 0, 5, 20 and 50 wt% as a parameter. On the ordinate is plotted the ratio of the breakdown voltage to that of the conventional Cu-Co alloy, and on the abscissa, the amount of Ta. In FIG. 6, solid lines and dotted lines show values having no variation and values having variation, respectively.

As is clear from FIG. 6, the breakdown voltage of the ternary alloy is much improved compared with the conventional binary alloy. For example, when the amount of Co is set at 20 wt%, the inventive ternary alloy containing even a small amount of Ta provides a sufficient breakdown voltage performance without sacrificing the interrupting performance. In comparison, with the conventional Cu-Co binary alloy containing 50 wt% Co or more, the desired interrupting performance is substantially lost.

On the other hand, if the amount of Co is small, while a sufficient breakdown voltage performance is expected, it is necessary to increase the amount of Ta. Thus the amount of Co should be 5 wt% or more. Further, the total amount of Co and Ta should be 10 wt% or more in view of the breakdown performance.

In view of the total performance of the ternary alloy, it is clear from FIGS. 5 and 6 that when the amounts of Co and Ta are selected in ranges 5 to 30 wt% and 5 to 30 wt%, respectively, both the interrupting and breakdown performance are most effectively improved.

It has been found from other measurements of contact resistance of the present ternary alloy contact that the contact resistance becomes a minimum and is stable when the total amount of Co and Ia is 40 wt% or less.

In experiments the results of which are shown in FIGS. 5 and 6, the intermetallic compound of Co and Ta, i.e., $Co_2Ta$, is formed and Co, Ta and $Co_2Ta$ are uniformly and finely dispersed in Cu. However, a contact alloy containing Cu, Co and Ta dispersed in Cu without forming $Co_2Ta$ (which can be achieved by using a lower sintering temperature) has substantially the same properties as the alloy containing the intermetallic compound $Co_2Ta$, and exhibits a substantially higher interrupting performance than the conventional Cu-Co alloy. This may be for the reason that Co and Ta, which are initially finely dispersed in Cu, react with each other during arc generation. It has been found, however, that the Cu-Co-Ta ternary alloy containing an intermetallic compound of Co and Ta exhibits a higher interrupting performance than the Cu-To-Ta ternary alloy containing no intermetallic compound.

Although the inventive ternary alloy has been described as being prepared by mixing powders of these elements, and shaping and sintering the mixture, the alloy may be manufactured by a melt molding process with substantially the same effects as these obtainable by the sintering process.

Further, although not shown, Co in the alloy may be replaced at least partially by Fe with substantially the same effects as the Cu-Co-Ta alloy. This may be for the reason that Fe together with Ta forms an intermetallic compound $Fe_2Ta$, similar to the case of Co, which may affect the interrupting performance advantageously.

It has been found that if the Cu-Co-Ta ternary alloy or Cu-Fe-Ta ternary alloy further contains at least one of Ti, Zr and Al in an amount of 5 wt% or less, a more favorable interrupting performance can be obtained. In this case. Ti, Zr and/or Al in the ternary alloy may form a component or components which are effective in improving the interrupting performance. When the amount of the additive exceeds 5 wt%, the reaction of it with the Cu matrix becomes excessive, providing a substantially reduced electrical conductivity, and hence causing the interrupting performance as well as the contact resistance to be degraded.

Further, it has been found that a contact material for use in a low breaking capacity vacuum circuit interrupter, which material contains, in addition to the three elements, at least one low melting point metal selected from the group consisting of Bi, Te, Sb, Tl, Pb, Se, Ce and Ca, and alloys thereof, an intermetallic compound thereof and an oxide thereof in an amount of 20 wt% or less is effective in improving the interrupting performance and the breakdown performance as in the case of the above-described embodiment. If the amount of the additive exceeds 20 wt%, the interrupting performance is considerably degraded. It should be noted that if Ce or Ca is used as the low melting point metal, other properties of the contact are slightly degraded.

As described hereinbefore, the present invention resides in a contact material for use in a vacuum circuit interrupter which contains copper as a first component, tantalum as a second component, and at least one of cobalt and iron as a third component, the amount of the second component being 60 wt% or less, the amount of the third component being 50 wt% or less, and the total amount of the second and third components being 10 wt% or more. It has been found that this material provides a high current interrupting performance and breakdown voltage performance.

We claim:

1. A contact material for a vacuum circuit interrupter, comprising: a first component material of copper, a second component material of tantalum and a third component material selected from a group consisting of cobalt, iron, or a mixture of cobalt and iron, said third component material being present in an amount of not more than 50 wt%, and a combination of said second and third component materials being present in an amount of no less than 10 wt%, said third component material being present in an amount sufficient to react with said second component material, whereby interrupting and breakdown performance of the vacuum circuit interrupter are improved.

2. The contact material as claimed in claim 1, wherein said combination of said second and third component materials is present in an amount of no less than 10 wt% and no more than 60 wt%.

3. The contact material as claimed in claim 1, wherein said second component material is present in an amount of 5 to 30 wt% and said third component material is present in an amount of 5 to 30 wt%.

4. The contact material as claimed in claim 1, wherein said combination of said second and third component materials is present in an amount of no less than 10 wt% and no more than 40 wt%.

5. The contact material as claimed in claim 1, further comprising a fourth component material containing at least one of titanium, zirconium and aluminum, said fourth component material being present in an amount of no more than 5 wt%.

6. The contact material as claimed in claim 1, further comprising a fifth component material containing at least one of a low melting point metal, alloys of a low melting point metal, an intermetallic compound of a low melting point metal, and oxides thereof, said low melting point metal containing at least one metal selected from the group consisting of bismuth, tellurium, antimony, thallium, lead, selenium, cerium and calcium, said fifth component material being present in an amount of no more than 20 wt%.

* * * * *